US006478620B1

(12) United States Patent
Bonavita et al.

(10) Patent No.: US 6,478,620 B1
(45) Date of Patent: Nov. 12, 2002

(54) ELECTRICAL CONNECTOR

(75) Inventors: Michael J. Bonavita, Warren, PA (US); Steven M. Boyd, Warren, PA (US); Ronald E. Thomas, Warren, PA (US); Richard P. Walker, Saegertown, PA (US); Douglas G. Seymour, Lakewood, NY (US)

(73) Assignee: Tyco Electronics Logistics AG, Steinach SG (CH)

( * ) Notice: Subject to any disclaimer, the term of this patent is extended or adjusted under 35 U.S.C. 154(b) by 0 days.

(21) Appl. No.: 09/510,077

(22) Filed: Feb. 22, 2000

(51) Int. Cl.[7] ..... H01R 13/13
(52) U.S. Cl. ..... 439/595; 439/680; 439/589
(58) Field of Search ..... 439/595, 598, 439/587, 589, 594, 148, 752, 936, 274, 275, 204, 680

(56) References Cited

U.S. PATENT DOCUMENTS 5,071,369 A * 12/1991 Denlinger et al. ..... 439/595
5,634,807 A * 6/1997 Saito ..... 439/275
5,707,251 A * 1/1998 Sakai et al. ..... 439/589
5,931,699 A * 8/1999 Saito ..... 439/587
5,941,741 A 8/1999 Dobbelaere et al.
6,244,897 B1 * 6/2001 Shinozaki ..... 439/587
6,250,962 B1 * 6/2001 Shinozaki ..... 439/587

* cited by examiner

*Primary Examiner*—Renee Luebke
*Assistant Examiner*—Phuong Nguyen
(74) *Attorney, Agent, or Firm*—Brinks Hofer Gilson & Lione

(57) ABSTRACT

An electrical connector that comprises an electrically insulating housing having a front end and a back end displaced along a longitudinal axis. An electrical contact receiving aperture is formed in the housing and is arrayed parallel to the longitudinal axis. The back end of the connector housing further includes a contact receiving entrance that has a given cross-sectional, one-way footprint and has a given length "L" along the longitudinal axis. An electrical contact is positioned in the contact-receiving aperture, and has the same cross-sectional, one-way footprint as the entrance. At least a portion of the longitudinal length of the contact, designated "L1" is sufficient to retain engagement with the contact receiving entrance until the contact enters the electrical contact-receiving aperture in the insulating housing. The one-way footprint assures correct alignment of the contact with the housing aperture and allows for a much smaller contact with lesser spacing between contacts, thus allowing for a greater contact density and a miniaturization of the connector.

5 Claims, 7 Drawing Sheets

ELECTRICAL CONNECTOR

TECHNICAL FIELD

This invention relates to electrical connectors and more particularly to miniature electrical connectors having superior alignment capabilities during assembly, increased contact density and ruggedness suitable for automotive applications.

BACKGROUND ART

Electrical connectors are used in multiple applications in many areas. Particularly prevalent is their use in automobiles where the current emphasis has been on combining great reliability, miniaturization and reduced cost. These features have been absent from the connectors now on the market.

DISCLOSURE OF INVENTION

It is, therefore, an object of the invention to obviate the disadvantages of the prior art.

It is another object of the invention to enhance connector assembly operations.

It is yet another object of the invention to provide a connector that is economical to manufacture, small in size yet provided with increased density of contacts.

It is still another object of the invention to provide a connector housing having provisions for accepting electrical contacts that are of less than perfect configuration.

These objects are accomplished, in one aspect of the invention, by an electrical connector that comprises an electrically insulating housing having a front end and a back end displaced along a longitudinal axis. An electrical contact receiving aperture is formed in the housing and is arrayed parallel to the longitudinal axis. The back end of the connector housing further includes a contact receiving entrance that has a given cross-sectional, one-way footprint and has a given length "L" along the longitudinal axis. An electrical contact is positioned in the contact-receiving aperture, and has the same cross-sectional, one-way footprint as the entrance. At least a portion of the longitudinal length of the contact, designated "L1" is sufficient to retain engagement with the contact receiving entrance until the contact enters the electrical contact-receiving aperture in the insulating housing.

The one-way footprint assures correct alignment of the contact with the housing aperture and allows for a much smaller contact with lesser spacing between contacts, thus allowing for a greater contact density and a miniaturization of the connector.

In a preferred embodiment of the invention, the contact receiving aperture in the housing has a slightly larger cross-section than that of the contact and, additionally, has a grosser shape than that of the given, one-way, cross-sectional footprint, which permits slightly misaligned or crooked contacts to still be fed into the connector housing. This provision, which allows the connector to accept contacts of less than perfect configuration, reduces the cost of assembly of the connector. In a still further embodiment, the contact-receiving aperture in the connector housing includes a locking tongue that fixedly holds a completely inserted contact within the aperture.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
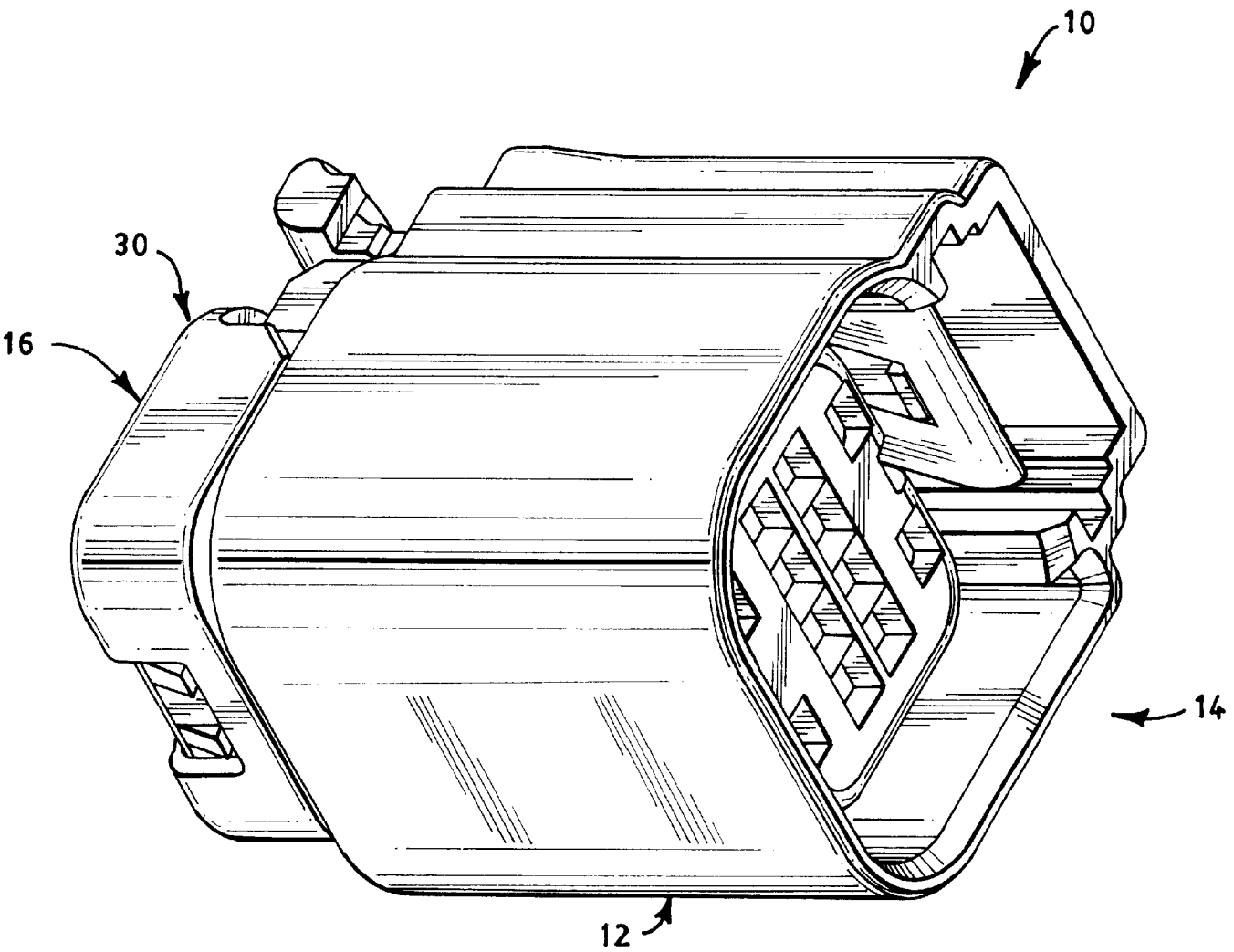
FIG. 1 is a perspective view of a connector housing in accordance with an aspect of the invention.
Figure 2:
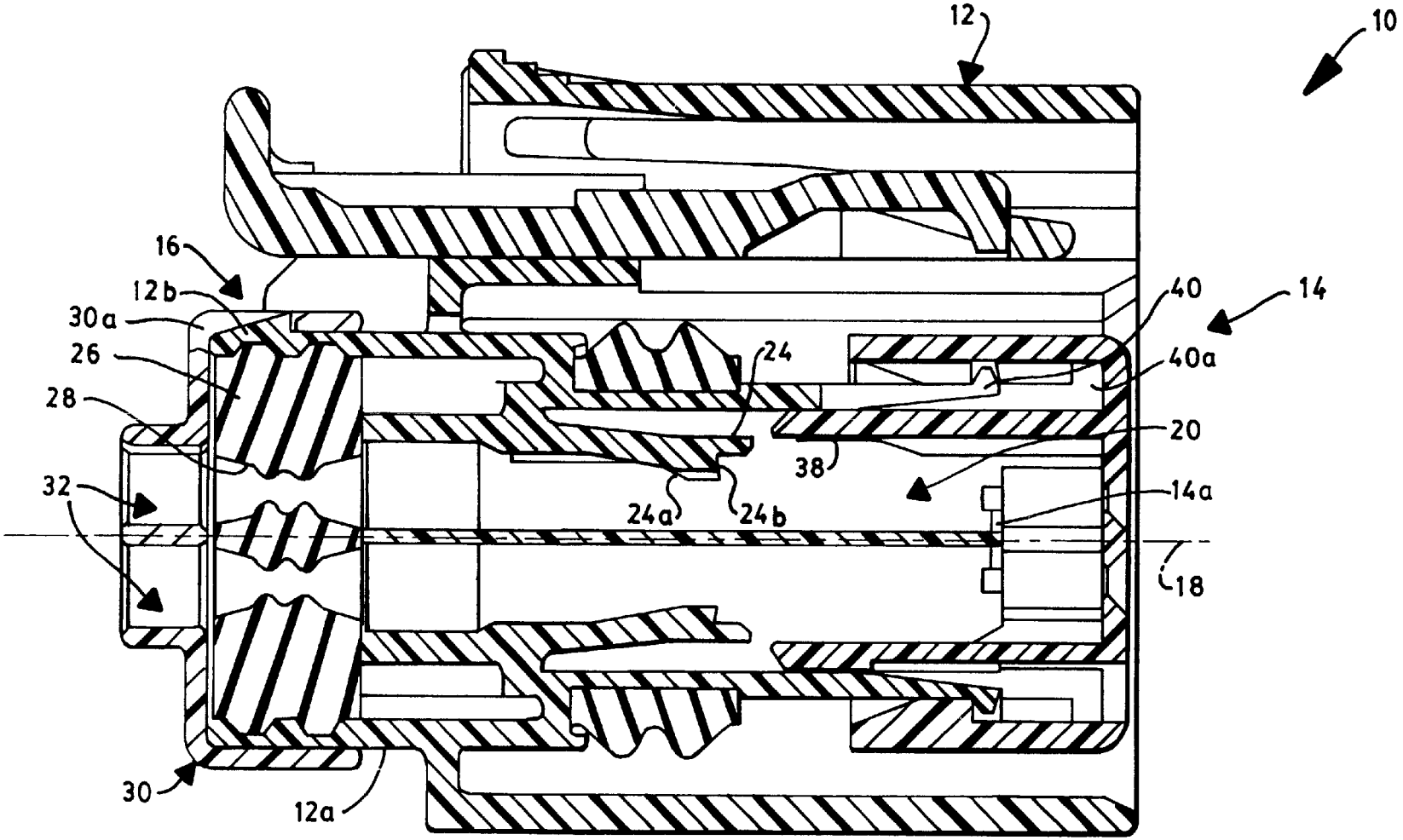
FIG. 2 is an elevational, sectional view of the connector of FIG. 1.

Referring now to the drawings with greater particularity, there is shown in FIG. 1 an electrical connector 10 having an electrically insulating housing 12, a front end 14 and a rear end 16, displaced along a longitudinal axis 18 (see FIG. 2.). A plurality of electrical contact receiving apertures 20 extends through the housing 12.

Formed interiorly of aperture 20 is a locking tongue 24 having a cam edge 24*a* and contact stop 24*b*. A flexible gasket 26 is positioned at the rear end 16 of housing 12 and fits inside a housing extension 12*a* and contains a plurality of contact receiving gasket apertures 32, alike in number and location to apertures 20.

Figure 5:
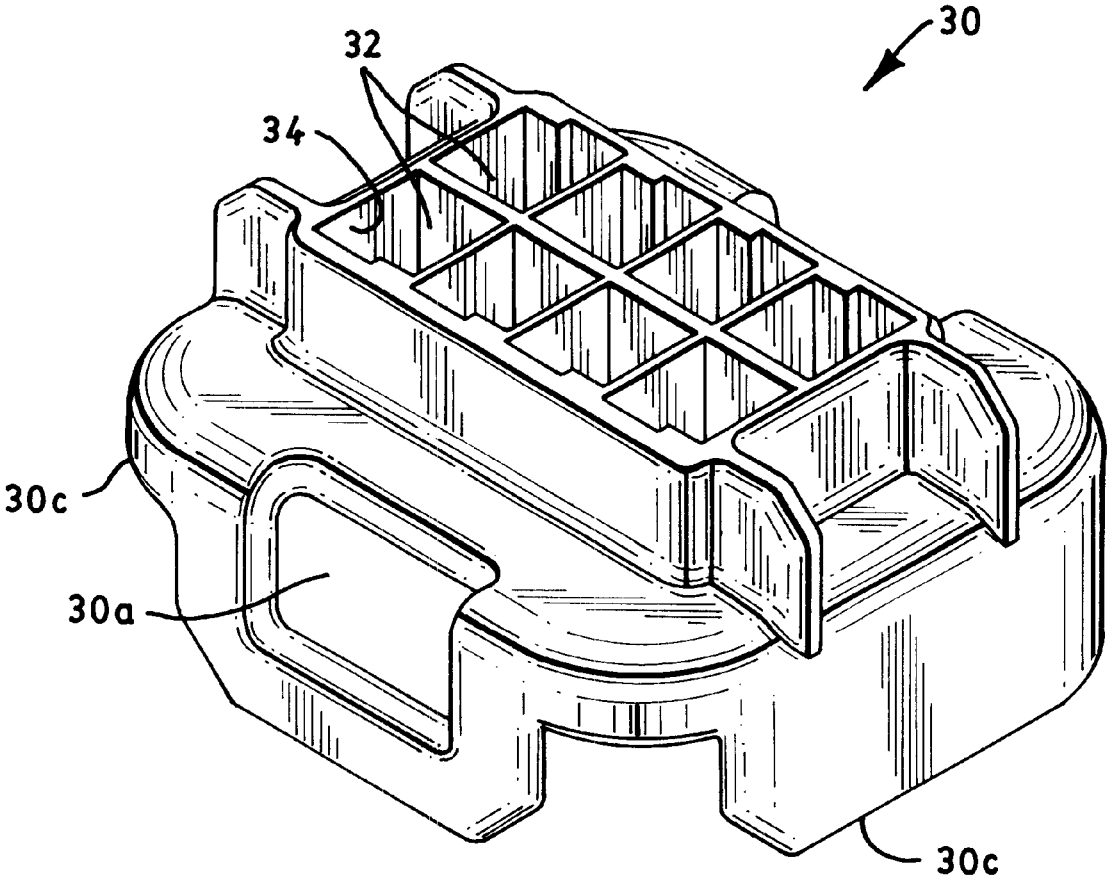
FIG. 5 is a perspective view of the gasket retainer illustrating one embodiment of a one-way, cross-sectional area.
Figure 6:
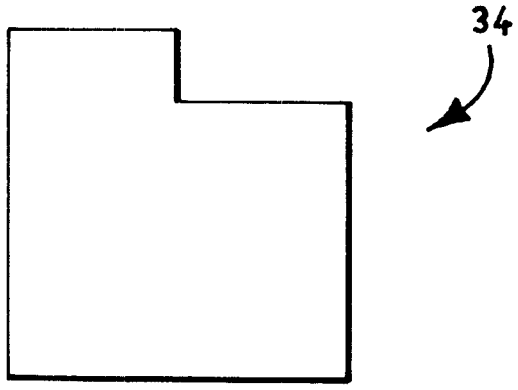
FIG. 6 is a diagrammatic view of the one embodiment of the one-way cross-sectional area.

A gasket retainer 30 is fitted over housing extension 12*a* and fixed thereon by at least one cammed boss 12*b* on housing extension 12*a* engaging a formed opening 30*b* in a peripheral wall 30*c* of the gasket retainer 30. The gasket retainer 30 is provided with a plurality of electrical contact receiving entrances 32, each of which entrances having a given cross-sectional, one-way footprint 34. One embodiment of such a footprint is shown diagrammatically in FIG. 6 as comprising a basic quadrangle with a corner missing. The configuration is shown also in FIG. 5 which also illustrates a preferred embodiment wherein the entrances 32 of one row are oriented 180° from the other row.

Figure 7:
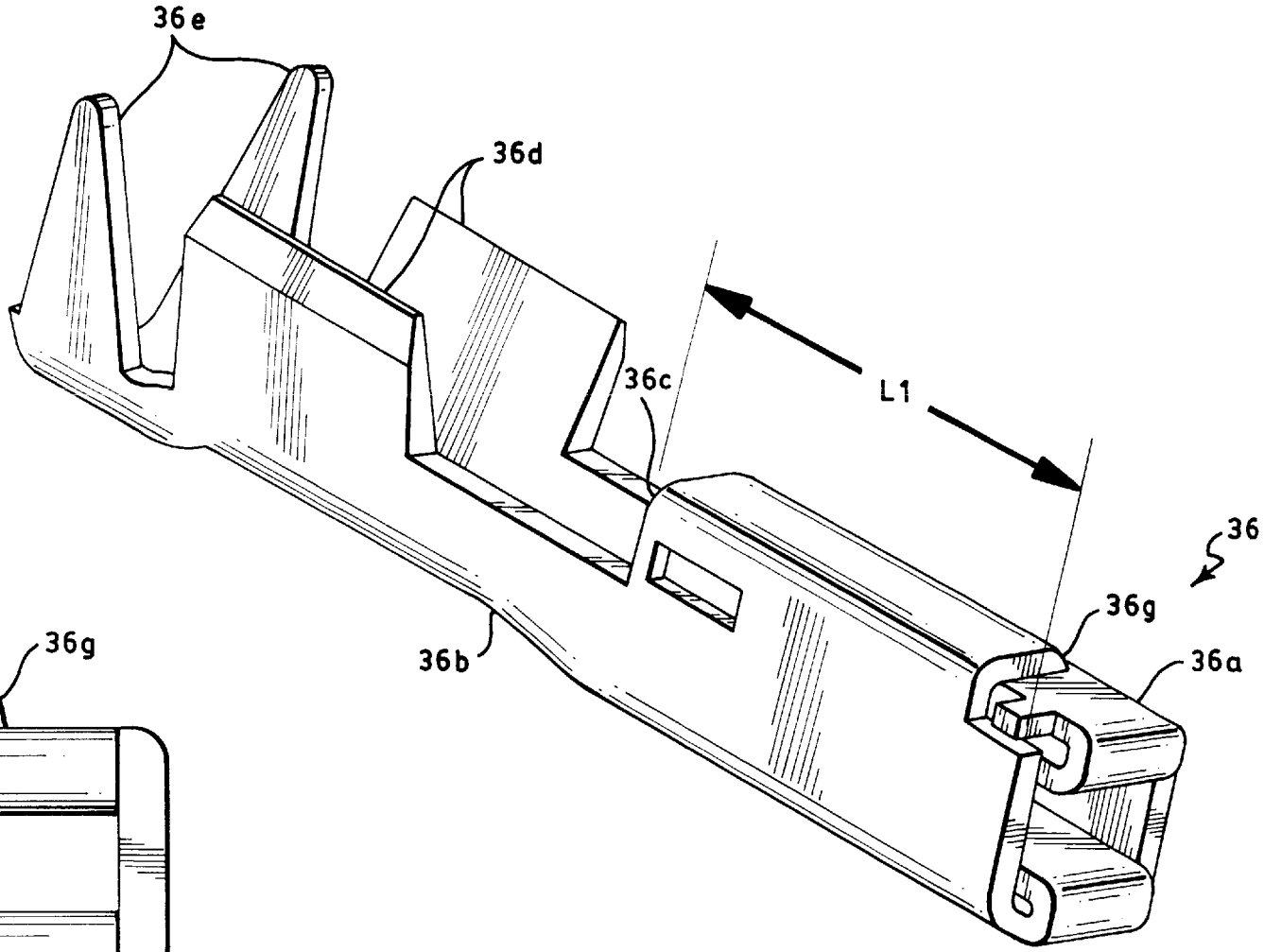
FIG. 7 is a perspective view of a contact employing the one-way cross-sectional area.
Figure 8:
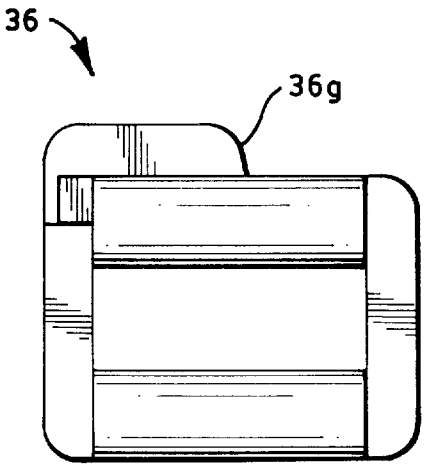
FIG. 8 is a front elevational view of the contact of FIG. 7.

An electrical contact 36 (FIG. 7) is positioned in housing aperture 20. By way of example, the contact 36 can be similar to one shown in U.S. Pat. No. 5,941,741. In this instance the electrical contact 36 is a female contact having a hollow, male receiving contact portion 36*a* which has the same cross-sectional, one-way footprint as entrance 32 so that contact 36 can be inserted into the housing 12 only one way. Positioned rearwardly from contact receiving portion 36*a* is a wire receiving portion 36*b* that has a second cross-sectional area smaller than cross-sectional area of the footprint. Area 36*b* is provided with wings 36*d* for crimping a stripped wire and wings 36*e* for crimping about the wire insulation, thus firmly attaching an electircal wire 36*f* (see FIG. 4) to the contact 36. Because the entrance 32 in gasket retainer 30 provides the necessary orientation, as will be described more fully hereinafter, it is not necessary for the electrical contact receiving aperture 20 in housing 12 to have the same footprint. Actually, it is preferred that aperture 20 have a grosser configuration than the contact. By "grosser" is meant a more regular configuration that will accept the one-way cross-section without requiring the original orientation. In this particular case, the cross-section of aperture 20 can be simply quadrangular, greatly simplifying the manufacture of housing 12 and reducing the cost. This feature also allows the insertion of a contact 36 that may have been slightly malformed during the wire crimping operation. Also, while the one-way cross-sectional area of this particular contact 36 has been shown to be a modified quadrangle formed by using an overlapping fold 36*g* on the top of the contact, it is to be understood that other unique cross-sections could be employed, such as elliptical or triangular. The important feature is that the entrance 32 and the initial or front portion of the contact 36 share the same cross-section and that this cross-section permits only a single, desired orientation.

Figure 4:
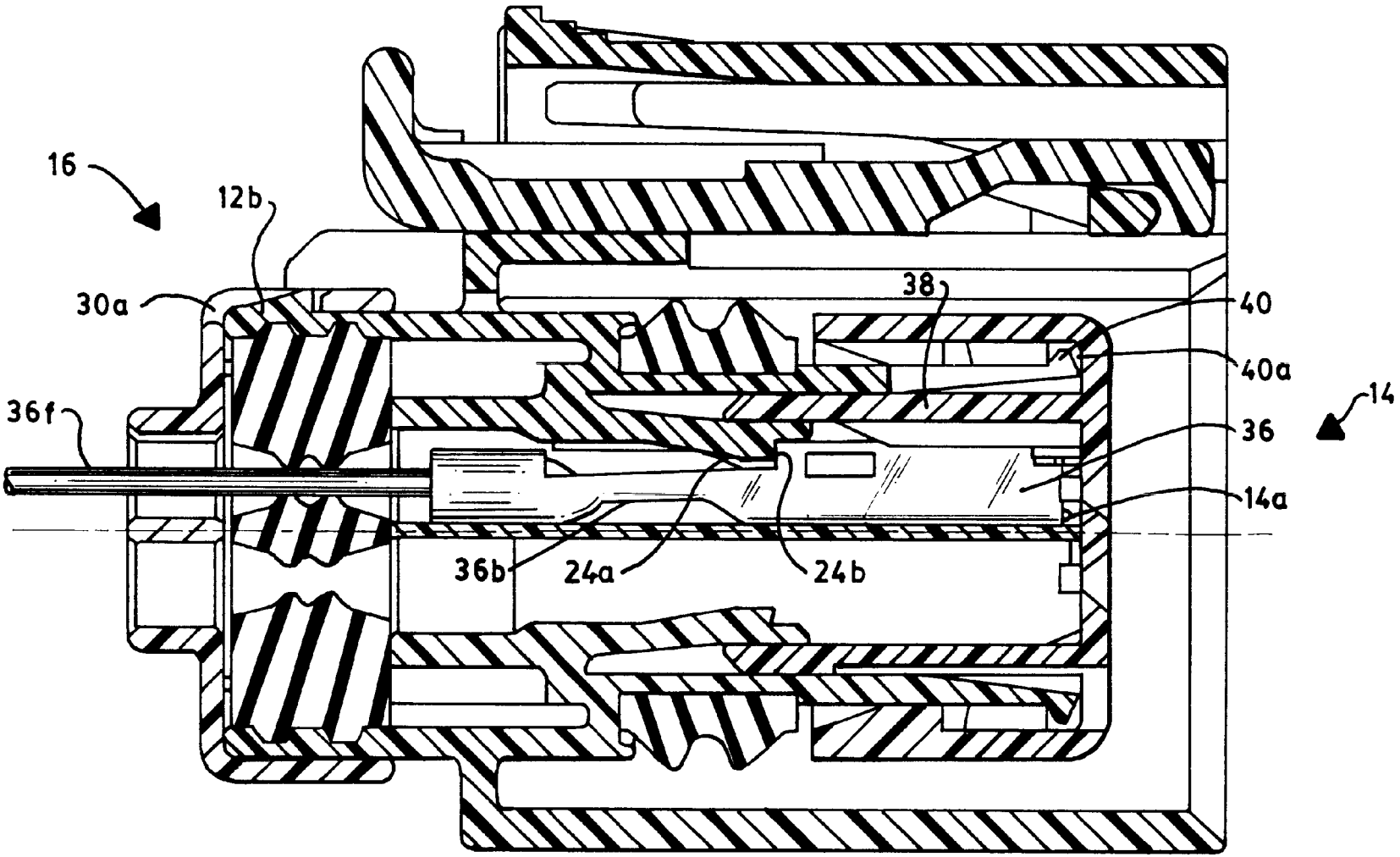
FIG. 4 is a view similar to FIG. 3 with a contact completely inserted and the locking tongue disabler in position.

When the contact 36 is fully inserted as shown in FIG. 4, the front of the contact will abut stop 14*a* while the contact stop 24*b* on flexible locking tongue 24 engages the rear lip 36*c* of the contact 36, thus completely fixing the contact 36 within aperture 20.

Figure 3:
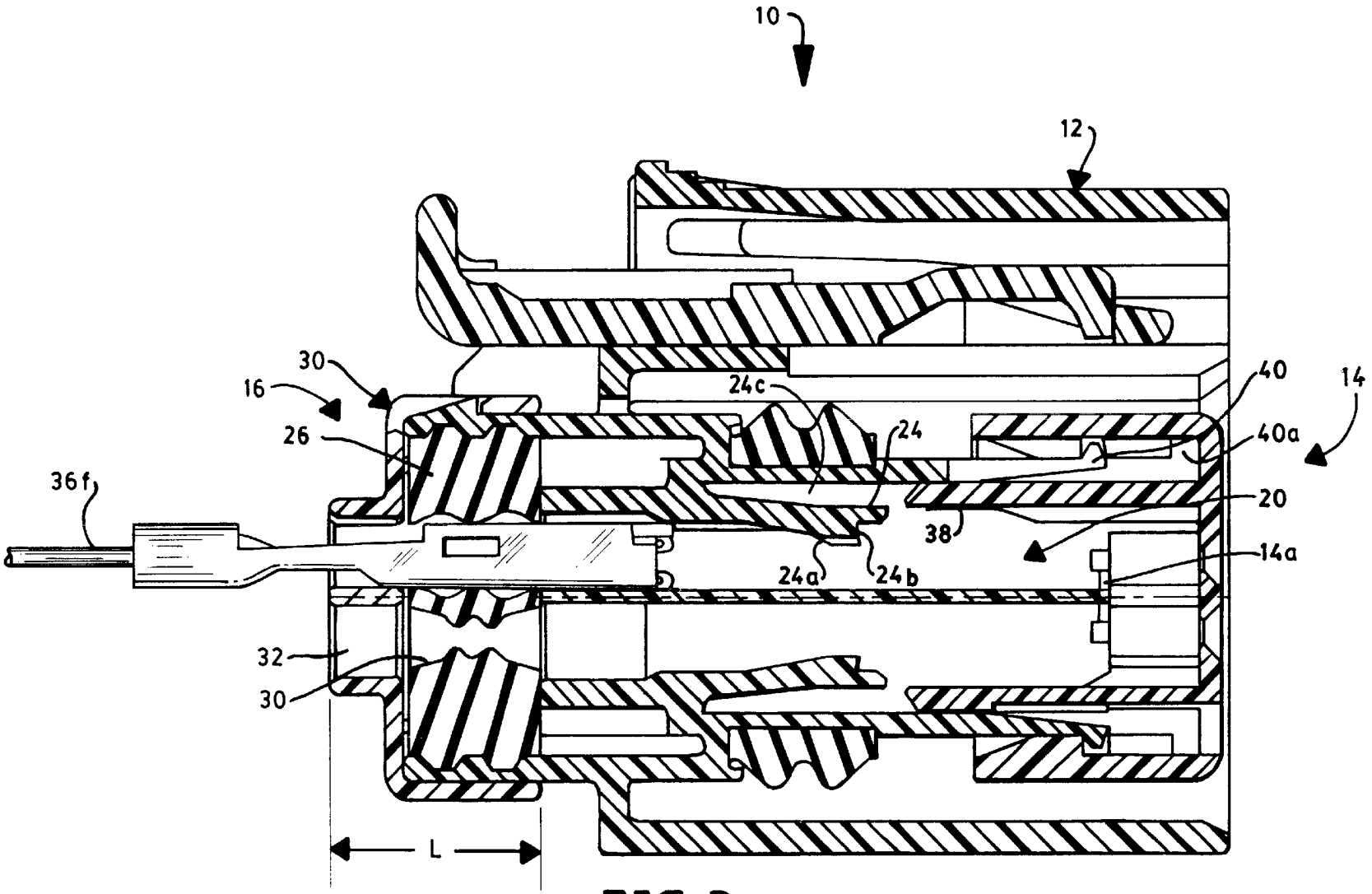
FIG. 3 a is view similar to FIG. 2 with a contact partially inserted and engaging the locking tongue.

Also important in insuring the proper alignment of contact 36 is the longitudinal length L1 of the male contact-receiving portion 36*a*. This length is at least as long as the length L, shown in FIG. 3, which is the length of the distance from the back end 16, containing the footprint 34, to the beginning of the aperture 20. This insures that the very front of contact 36 enters the aperture 20 before rear lip 36*c* of contact 36 leaves the orientation feature of the footprint.

Figure 9:
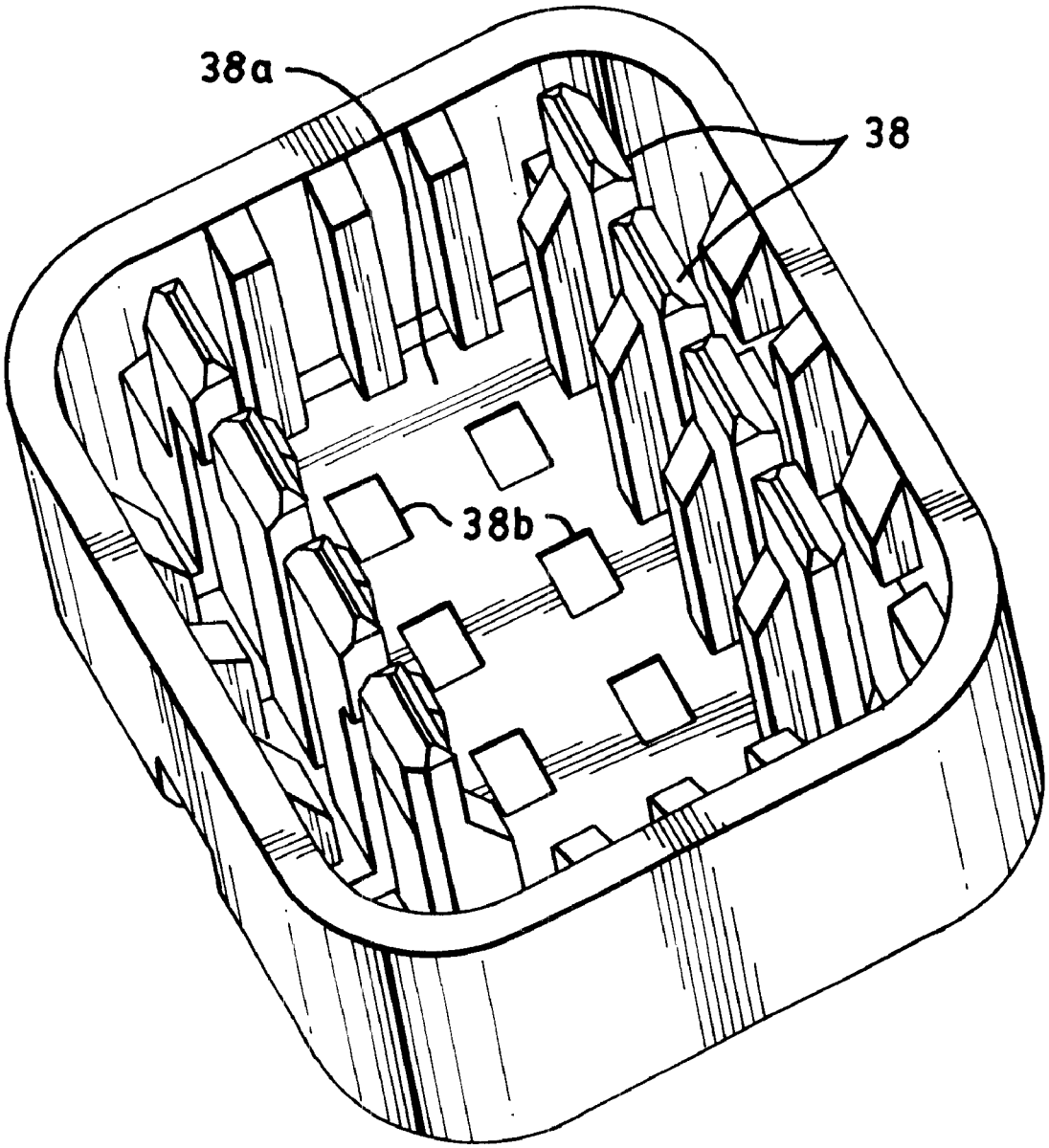
FIG. 9 is a perspective view of one form of locking tongue disabler.

As the contact continues its insertion into the aperture 20, the front end of contact 36 engages the cam 24*a* of the displaceable locking tongue 24 and lifts it into the space 24*c*. Upon the completion of the insertion, when contact 36 hits stop 14*a*, the tongue 24 will flex back to its original position and contact stop 24*b* will engage the rear lip 36*c* of contact 36. Then the locking tongue disabler 38 is pushed into position from the front end 14 of housing 12 thus preventing future movement on tongue 24 while the disabler is in position. This locking tongue disabler is shown in perspective view in FIG. 9. The disablers 38, one for each contact, project from a base 38*a* containing a plurality of male contact receiving openings 38*b* alike in number and location to the apertures 20. The locking tongue disabler is held in its fixed and operative position by prongs 40 formed on the housing 12 engaging slots 40*a* formed on an interior surface of disabler 38.

While there have been shown and described what are at present considered the preferred embodiments of the invention, it will be apparent to those skilled in the art that various changes and modifications can be made herein without departing from the scope of the invention as defined by the appended claims.

What is claimed is:

1. A miniature electrical connector comprising:

an electrically insulting housing having a front end and a rear end displaced along a longitudinal axis;

an electrical contact-receiving aperture in said housing arrayed parallel to said longitudinal axis;

a displaceable locking tongue in said electrical contact receiving aperture;

a flexible gasket positioned at said rear end of said housing, said flexible gasket having a contact receiving gasket aperture;

a gasket retainer affixed to said rear end of said housing, said gasket retainer having an electrical contact receiving aperture therein, said gasket retainer electrical contact receiving aperture having a given cross-sectional one-way footprint;

an electrical contact positioned in said housing aperture, said electrical contact having said given cross-sectional one-way footprint, whereby only a single orientation of said contact in said gasket retainer electrical contact receiving aperture is permitted, said contact being retained in said electrical contact receiving aperture by said locking tongue when said contact is fully inserted therein; and a displaceable locking tongue disabler associated with said front end.

2. The miniature electrical connector of claim 1 wherein: said gasket retainer has a plurality of electrical receiving apertures, at least some of said apertures having said given cross-sectional one-way footprints oriented 180° from others of said apertures.

3. The miniature electrical connector of claim 1 wherein: said front end is provided with electrical contact stops.

4. The miniature electrical connector of claim 1 wherein: said electrical contact is a female contact having a hollow, male contact receiving portion of a given cross-sectional area and a wire receiving portion spaced therefrom, said wire receiving portion having a second cross-sectional area that is smaller than said given cross-sectional area.

5. An electrical connector comprising:

an electrically insulating housing having a front end and a back end displaced along a longitudinal axis an electrical contact-receiving aperture in said housing arrayed parallel to said longitudinal axis;

said back end further including a contact receiving entrance having a given cross-sectional, one-way footprint and having a given length "L" along said longitudinal axis; and an electrical contact positioned in said contact receiving aperture, said electrical contact having said given, cross-sectional, one-way footprint and at least a portion of its longitudinal length "L1" sufficient to retain engagement with said contact receiving entrance until said contact enters said electrical contact receiving aperture in said insulating housing.

* * * * *

US006478620C1

(12) EX PARTE REEXAMINATION CERTIFICATE (7295th)

United States Patent
Bonavita et al.

(10) Number: US 6,478,620 C1
(45) Certificate Issued: Jan. 5, 2010

(54) ELECTRICAL CONNECTOR

(75) Inventors: Michael J. Bonavita, Warren, PA (US); Steven M. Boyd, Warren, PA (US); Ronald E. Thomas, Warren, PA (US); Richard P. Walker, Saegertown, PA (US); Douglas G. Seymour, Lakewood, NY (US)

(73) Assignee: Tyco Electronics Logistics AG, Steinach SG (CH)

Reexamination Request:
No. 90/010,427, Feb. 27, 2009

Reexamination Certificate for:

| | |
|---|---|
| Patent No.: | **6,478,620** |
| Issued: | **Nov. 12, 2002** |
| Appl. No.: | **09/510,077** |
| Filed: | **Feb. 22, 2000** |

(51) Int. Cl.
*H01R 13/13* (2006.01)

(52) U.S. Cl. ..... 439/595; 439/680; 439/589

(58) Field of Classification Search ..... None
See application file for complete search history.

(56) References Cited

U.S. PATENT DOCUMENTS 5,575,683 A 11/1996 Saito et al. ..... 439/595

*Primary Examiner*—My-Trang Ton

(57) ABSTRACT

An electrical connector that comprises an electrically insulating housing having a front end and a back end displaced along a longitudinal axis. An electrical contact receiving aperture is formed in the housing and is arrayed parallel to the longitudinal axis. The back end of the connector housing further includes a contact receiving entrance that has a given cross-sectional, one-way footprint and has a given length "L" along the longitudinal axis. An electrical contact is positioned in the contact-receiving aperture, and has the same cross-sectional, one-way footprint as the entrance. At least a portion of the longitudinal length of the contact, designated "L1" is sufficient to retain engagement with the contact receiving entrance until the contact enters the electrical contact-receiving aperture in the insulating housing. The one-way footprint assures correct alignment of the contact with the housing aperture and allows for a much smaller contact with lesser spacing between contacts, thus allowing for a greater contact density and a miniaturization of the connector.

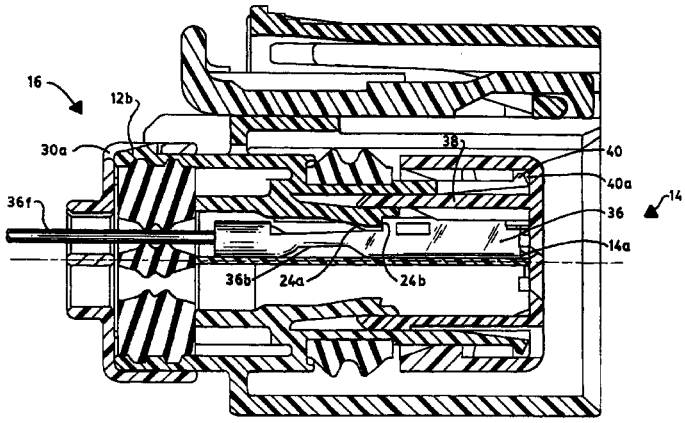

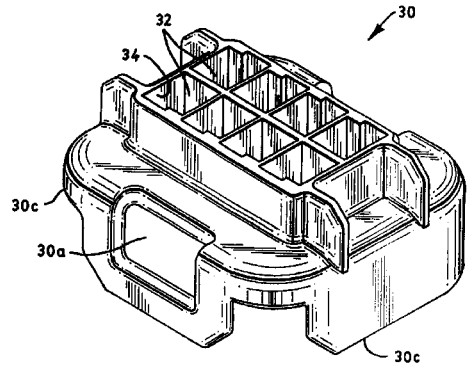

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 3 is confirmed.

Claims 2, 4 and 5 were not reexamined.

* * * * *